United States Patent [19]

Wellman

[11] 4,113,153

[45] Sep. 12, 1978

[54] GAS PUMP NOZZLE

[76] Inventor: James H. Wellman, 1809 San Andres, Santa Barbara, Calif. 93101

[21] Appl. No.: 792,463

[22] Filed: Apr. 29, 1977

[51] Int. Cl.[2] ..... B65D 25/40

[52] U.S. Cl. ..... 222/571; 141/286

[58] Field of Search ..... 137/312; 138/37; 141/86, 115, 116, 118, 124, 126, 264, 286, 392; 222/571, 108, 109; 239/110, 120, 121, 122; 220/86 R, DIG. 5

[56] References Cited

U.S. PATENT DOCUMENTS

| | | | |
|---|---|---|---|
| 1,984,005 | 12/1934 | Young | 141/116 X |
| 2,508,124 | 5/1950 | Stephenson | 220/86 R |
| 2,723,680 | 11/1955 | Danel | 138/37 X |
| 3,133,564 | 5/1964 | Hunter | 220/86 R |
| 3,289,890 | 12/1966 | Schild | 222/571 |

*Primary Examiner*—Richard E. Aegerter
*Assistant Examiner*—Frederick R. Schmidt
*Attorney, Agent, or Firm*—B. Deon Criddle

[57] ABSTRACT

A gas pump nozzle and anti-spill device for use with conventional fuel delivery pumps to eliminate spillage and loss of fuel when pumping is stopped and the nozzle is withdrawn from a gas tank filler. The nozzle is divided and has baffles to capture and channel the flow of excess fuel back to the pump reservoir upon removal of the nozzle from the gas tank filler.

3 Claims, 2 Drawing Figures

GAS PUMP NOZZLE

BRIEF DESCRIPTION OF THE INVENTION

1. Field of the Invention

This invention relates to nozzles for use with gas pumps, and particularly to gas pump nozzles, or the like, which act to prevent excess fuel remaining in the nozzle and delivery hose from being discharged from the open end of the nozzle as it is removed from a gas tank filler.

2. Prior Art

Anti-drip devices to prevent loss and spillage of fluids from various types of spouts and nozzles have previously been proposed. These known devices have generally involved the alteration of the end shape of other existing spouts, or the use of capping devices for the nozzle end.

No other gas pump nozzle, to the best of my knowledge, has had a baffle incorporated within the nozzle to capture and channel excess fuel remaining after pump shut off back into the pump reservoir. However, other nozzles have heretofore incorporated baffles for other purposes or have incorporated a spring biased closure to prevent loss or spillage of excess fuel and to insure return of the fuel to the pump reservoir upon return of the nozzle to an upright position.

U.S. Pat. No. 1,984,005, for example, discloses the use of a baffle in a fluid dispensing device to prevent improper filling of the device through the nozzle.

In U.S. Pat. No. 2,134,281 there is disclosed a baffle in a pouring device for bottles, the baffle being arranged to provide an even flow of air into the bottles during the pouring operation.

U.S. Pat. No. 3,951,315 discloses the use of a spring loaded check valve device for the end of a gas pump nozzle. The check valve opens when gasoline is being pumped but closes to prevent loss or spillage of fuel when pumping is stopped.

SUMMARY OF THE INVENTION

Principal objects of the present invention are to provide a gas pump nozzle with an inner baffle which captures excess fuel remaining in the nozzle and delivery hose after pumping of fuel therethrough has stopped and that will channel such fuel back to the pump reservoir when the nozzle is raised to an upright position.

Other objects are to provide a gas pump nozzle with an inner baffle for preventing loss of excess fuel but that will not impede the normal pumping flow of a conventional gasoline pump and a nozzle that can be readily used in place of the conventional nozzles now used.

Still another object is to provide a fuel saving nozzle that is easily produced from the same materials now used, in the same manner as existing nozzles and at little additional cost over such conventional nozzles.

Principle features of the present invention include an inner baffle positioned in a gas pump nozzle that is similar in most other respects to conventional nozzles. The baffle is preferably formed as one piece within the nozzle and extending fully from the pump or inlet and of the nozzle to the discharge end of the nozzle. The baffle separates the nozzle into compartments, one outer curve compartment following the outer curve of the nozzle and providing the major fluid flow compartment and the other inner curve compartment following the inner curve of the nozzle and providing an excess-fuel capture and return compartment.

The baffle generally follows the curvature of the gas pump nozzle until it nears the discharge end of the nozzle where it smoothly merges into the nozzle wall and closes off the inner curve compartment. The compartments are open at the pump or inlet end of the nozzle but the opening to the inner curve compartment is substantially constricted. Near the discharge end of the nozzle the baffle has louvered openings therethrough connecting outer and inner curve compartment.

Additional objects and features of the invention will become apparent from the following detailed description and claims, taken together with the accompanying drawings showing a preferred embodiment of the invention.

THE DRAWINGS

In the drawings:

FIG. 1 is a vertical cross sectional view of the invention; and

FIG. 2, a horizontal cross section view taken on the line 2—2 of FIG. 1.

DETAILED DESCRIPTION

Figure 1:
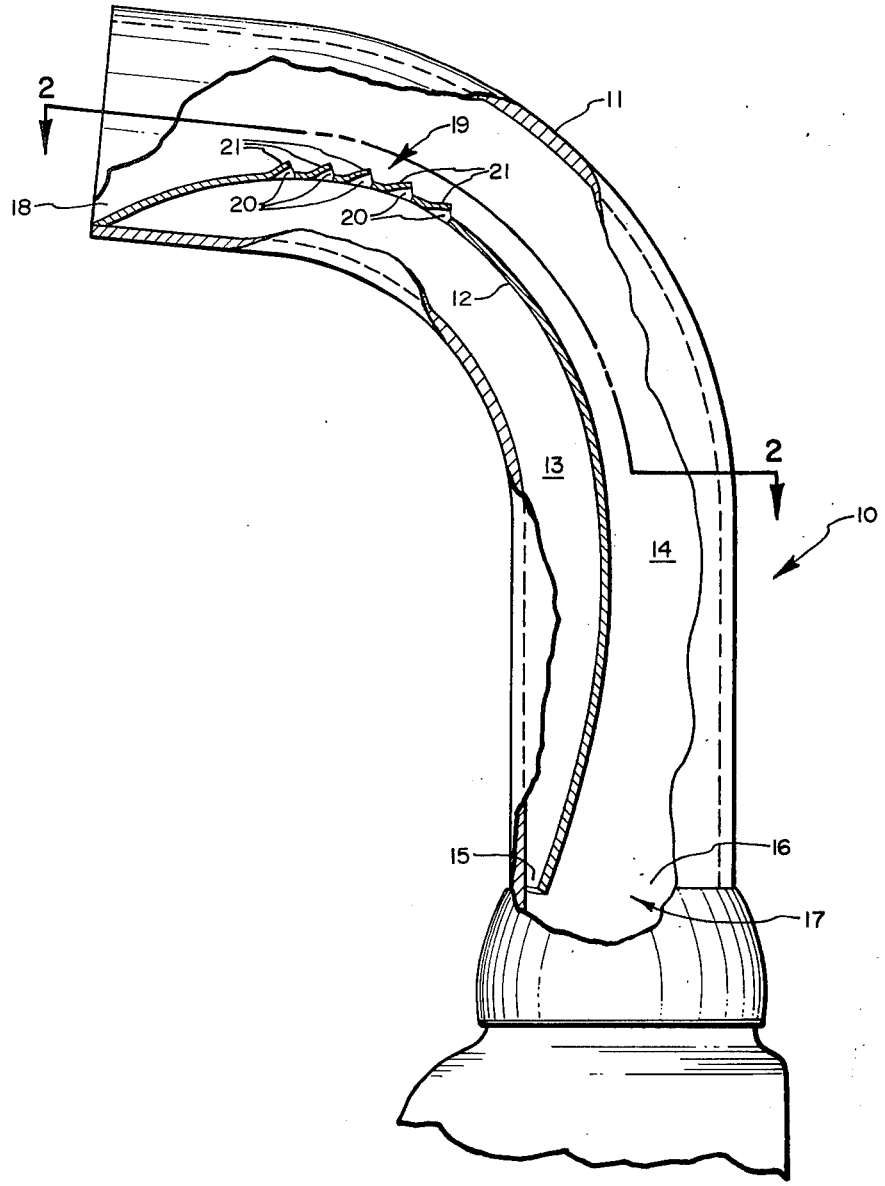
Figure 2:
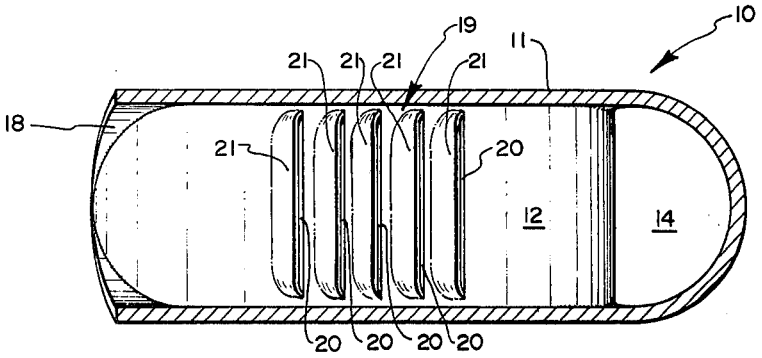

Referring now to the drawings:

In the illustrated preferred embodiment, the gas pump nozzle 10 of the present invention includes a conventional nozzle housing 11 and an inner baffle 12. The baffle 12 separates the inner cavity of the nozzle housing 11 into compartments 13 and 14, with one inner curve compartment 13 following an inner curve of the nozzle housing and the other outer curve compartment 14 following an outer curve of the nozzle housing 11. Both compartments are open at the pump or inlet end of the nozzle housing 11.

The baffle 12 is angled to form a smaller opening 15 for the inner curve compartment 13 and a larger opening 16 for the outer curve compartment at the intake opening 17 of the nozzle. The baffle 12 extends fully between opposite side walls of the nozzle housing and curves to engage the inner curving wall portion of housing 11 at the discharge opening 18 of the nozzle.

A short distance from the discharge opening 18 and between the curve of the nozzle and the discharge opening of the nozzle the baffle is provided with louvered openings, shown generally at 19. Each louvered opening includes a slot 20 through the baffle 12 and an upstanding louver 21 on the side of the slot downstream with respect to flow from the pump. The louvers 21 each extend downwardly from the baffle 12 into the outer curve compartment and may extend normal to the baffle surface or be slightly angulated therefrom in the direction of flow through the nozzle from the pump.

When the gasoline pump (not shown) is operated, to supply gasoline to the nozzle 10, some limited flow is through the constricted opening 15, the inner curve compartment 13, the slots 20 and out the discharge end of the nozzle. At the same time, most of the gasoline supplied to the nozzle passes through the larger opening 16, the outer curve compartment 14 and the discharge opening 18. After the gasoline is shut off gasoline will continue to briefly flow from the inner curve compartment 13 through slots 20 into the outer curve compartment 14 and from the outer curve compartment through the discharge opening 18 so long as the nozzle is tilted, as it normally is when gasoline is being fed into a vehicle storage tank, i.e. with the discharge end of the nozzle extending downwardly, and so long as the end of the inner curve compartment adjacent to the discharge opening 18 contains enough gasoline that it will back up and flow through the slots 20. Thereafter, any further gasoline in the nozzle or hose interconnecting the nozzle to the pump will flow directly into the inner curve compartment 13 or on the baffle to the slots 20 and into the inner curve compartment.

When the nozzle is withdrawn from the filler spout of a vehicle gasoline storage tank and is raised to and is hung in conventional fashion on the gasoline dispenser the gasoline trapped in the inner curve compartment flows along the inner curve of the nozzle housing 12, back through the nozzle, the hose (not shown), and the pump (not shown), to the pump reservoir.

It will be apparent that with the present invention, excess gasoline remaining in the nozzle and hose after pump shut off is not discharged onto the ground, but, instead, is returned to the pump reservoir. The disclosed structure thus avoids the waste and inconvenience frequently resulting from use of conventional gas pump nozzles that do not include such an inner baffle.

Although a preferred form of my invention has been disclosed herein, it is to be understood that the present disclosure is made by way of example and that variations are possible without departing from the subject matter coming within the scope of the following claims, which subject matter I regard as my invention.

I claim:

1. A nozzle for use with gasoline pumps and the like, comprising a gasoline pump nozzle housing having an inlet end adapted to be connected to a gasoline pump, a discharge end and a curved portion intermediate said inlet and discharge ends;

a baffle in the nozzle housing, said baffle extending from said inlet end to said outlet end between opposite side walls of the nozzle housing and forming with said housing an inner curve compartment and an outer curve compartment, said inner curve compartment being closed at a discharge end of the nozzle and open at the inlet end of the nozzle and the outer curve compartment being open at both the inlet end and the discharge end of the nozzle;

openings through the baffle to interconnect the inner curve compartment and the outer curve compartment, said openings being between said curved portion of said nozzle and said discharge end thereof; and a louver adjacent each opening through the baffle, at least one of said louvers being at the downstream side of an opening when flow is being pumped through the housing from said inlet end to said outlet end, said louvers extending from said baffle into said outer curve compartment to channel the flow of excess fluid into said inner curve compartment.

2. A nozzle as in claim 1, wherein each louver is angulated from the baffle opposite to the direction of flow from the pump through the housing.

3. A nozzle as in claim 2, wherein the openings through the baffle comprise slots extending transversely to flow through the housing from the pump.

* * * * *